US008033861B2

(12) United States Patent
Zhu

(10) Patent No.: US 8,033,861 B2
(45) Date of Patent: Oct. 11, 2011

(54) ELECTRICAL CONNECTOR WITH IMPROVED BOARD LOCK HAVING ELASTIC PORTION ABUTTING AGAINST OPTICAL DRIVE DISK

(75) Inventor: Yu Zhu, Shenzhen (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 97 days.

(21) Appl. No.: 12/549,562

(22) Filed: Aug. 28, 2009

(65) Prior Publication Data

US 2010/0055977 A1 Mar. 4, 2010

(51) Int. Cl.
*H01R 13/66* (2006.01)

(52) U.S. Cl. ..... 439/567

(58) Field of Classification Search ..... 439/567, 439/79, 660, 607.01
See application file for complete search history.

(56) References Cited

U.S. PATENT DOCUMENTS

| | | | | |
|---|---|---|---|---|
| 6,053,763 | A * | 4/2000 | Brennan et al. | 439/491 |
| 6,077,115 | A * | 6/2000 | Yang et al. | 439/567 |
| 6,159,023 | A * | 12/2000 | Lai | 439/79 |
| 6,386,910 | B1 * | 5/2002 | Yu | 439/567 |
| 6,565,383 | B1 * | 5/2003 | Wu | 439/567 |
| 6,679,727 | B1 * | 1/2004 | Yu | 439/567 |
| 7,726,983 | B2 * | 6/2010 | Zhu | 439/79 |
| 7,837,492 | B2 * | 11/2010 | Zhu | 439/329 |
| 7,850,486 | B2 * | 12/2010 | Zhu | 439/570 |
| 2009/0170368 | A1 | 7/2009 | Higeta et al. | |

* cited by examiner

*Primary Examiner* — Chandrika Prasad
(74) *Attorney, Agent, or Firm* — Wei Te Chung; Andrew C. Cheng; Ming Chieh Chang

(57) ABSTRACT

An electrical connector includes an insulative housing, a plurality of conductive terminals secured in the housing and a pair of board locks. The insulative housing includes an elongated main body having a horizontal mounting surface and a top surface opposite to the mounting surface. The main body defines a pair of boardlock-receiving cavities. Each board lock comprises a body portion received in respective cavity, a connection portion to be connected to a printed circuit board, and an elastic portion extending upwardly beyond the top surface of the body.

8 Claims, 9 Drawing Sheets

ELECTRICAL CONNECTOR WITH IMPROVED BOARD LOCK HAVING ELASTIC PORTION ABUTTING AGAINST OPTICAL DRIVE DISK

BACKGROUND OF THE INVENTION

1. Field of the Invention

The present invention relates to an electrical connection device, and more particularly to an electrical connector including a pair of board locks.

2. Description of Related Art

U.S. Pat. Pub. No. 2009/0170368 discloses an electrical connector, which comprises an insulative housing with a plurality of contacts received therein and a pair of board locks retained in the housing. Each board lock comprises a fixed portion for being fixed onto the housing and a soldering portion perpendicularly extending from the fixed portion and soldered to a printed circuit board by surface mounting technology (SMT). However, when an opposing mating connector is disengaged from the electrical connector, a large force exerts onto the electrical connector so that the electrical connector may be off from the circuit board easily.

It is thus desired to provide an electrical connector having a pair of improved board locks.

SUMMARY OF THE INVENTION

Accordingly, an object of the present invention is to provide an electrical connector with improved board locks for reliably positioning the connector on a printed circuit board.

In order to achieve the above-mentioned object, an electrical connector comprises an insulative housing, a plurality of conductive terminals secured in the housing and a pair of board locks. The insulative housing comprises an elongated main body having a horizontal mounting surface and a top surface opposite to the mounting surface. The main body defines a pair of boardlock-receiving cavities. Each board lock comprises a body portion received in respective cavity, a connection portion to be connected to a printed circuit board, and an elastic portion extending upwardly beyond the top surface of the body.

Other objects, advantages and novel features of the present invention will become more apparent from the following detailed description of the present embodiment when taken in conjunction with the accompanying drawings.

DETAILED DESCRIPTION OF THE INVENTION

Figure 1:
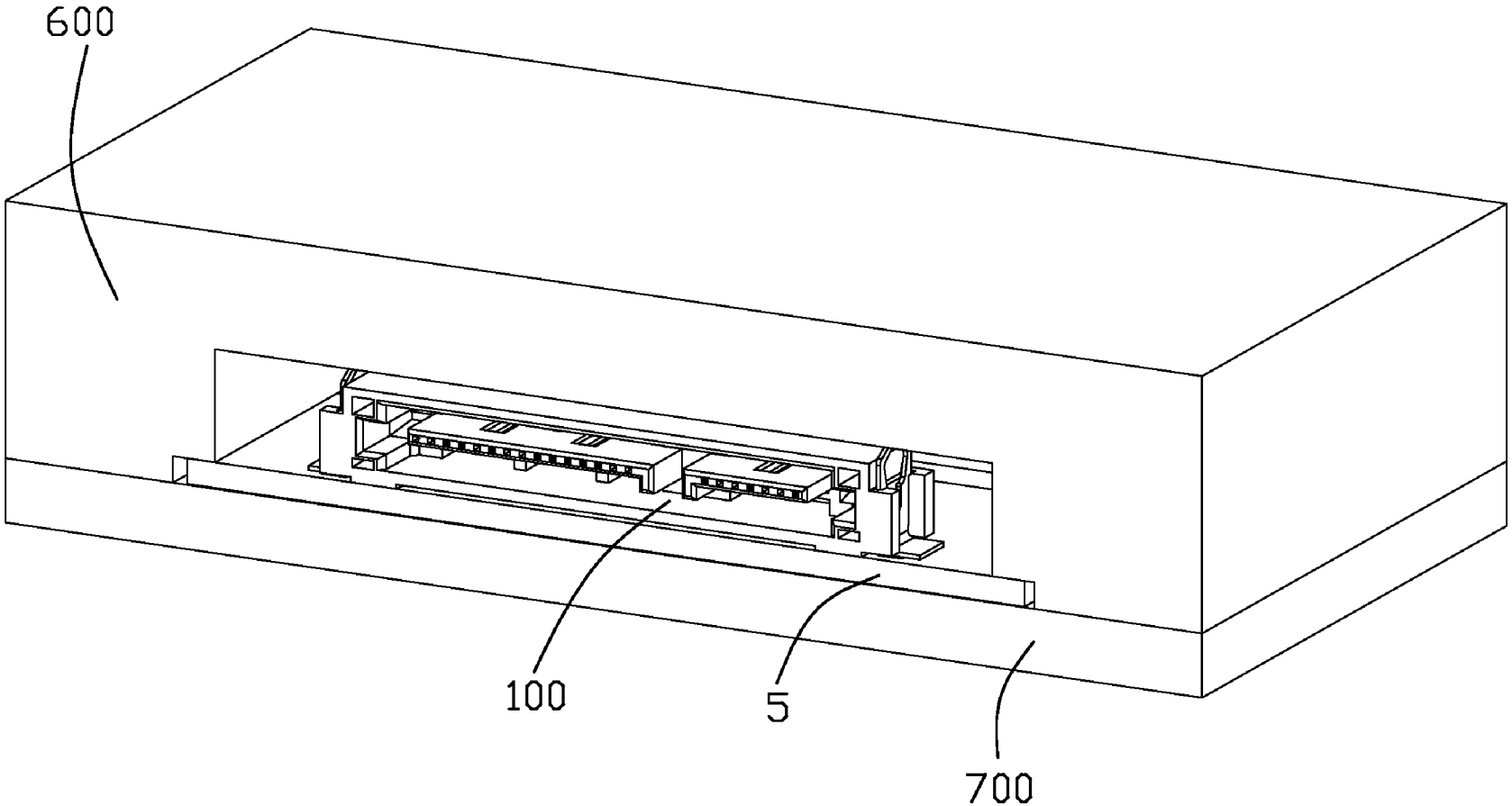
FIG. 1 is an assembled, perspective view of an electrical connector assembly mounted in an optical disk drive according to an embodiment of the present invention.
Figure 2:
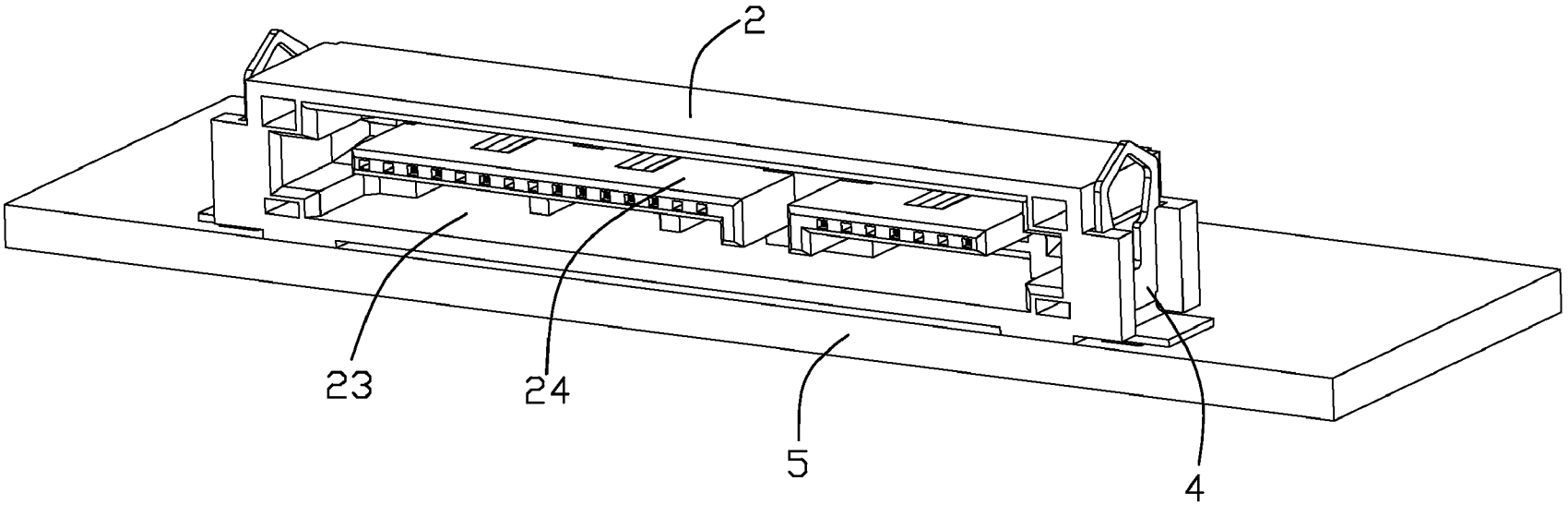
FIG. 2 is an assembled, perspective view of the electrical connector assembly.
Figure 3:
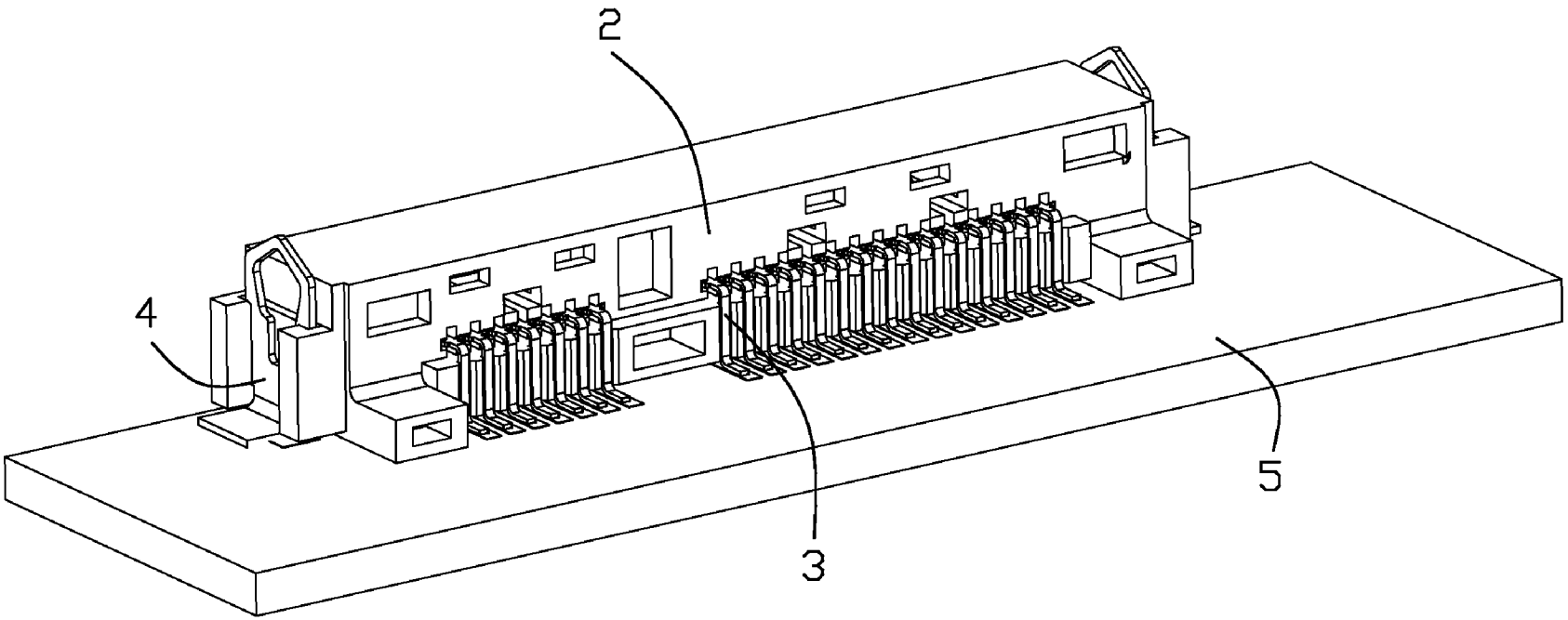
FIG. 3 is another perspective view of the electrical connector assembly of FIG. 2.

Referring to FIG. 1 to 4, an electrical connector assembly mounted onto an optical disk drive 600 according to an embodiment of the present invention is shown to include a printed circuit board 1 and an electrical connector 100 including an insulative housing 2, a plurality of terminals 3 retained in the housing 2 and a pair of board locks 4 for attaching the electrical connector 100 to the printed circuit board 1.

Figure 4:
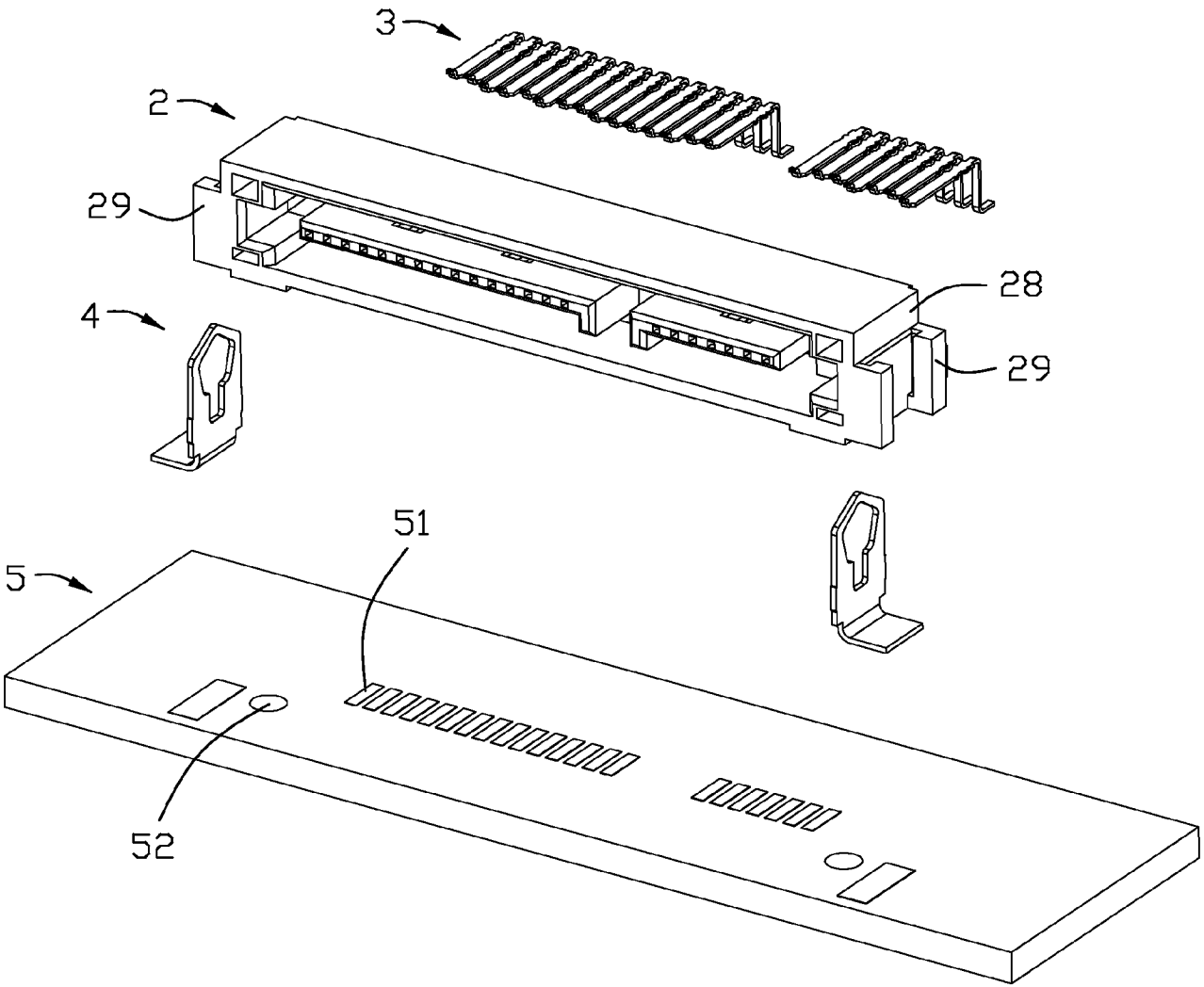
FIG. 4 is an exploded, perspective view of the electrical connector assembly of FIG. 2.
Figure 5:
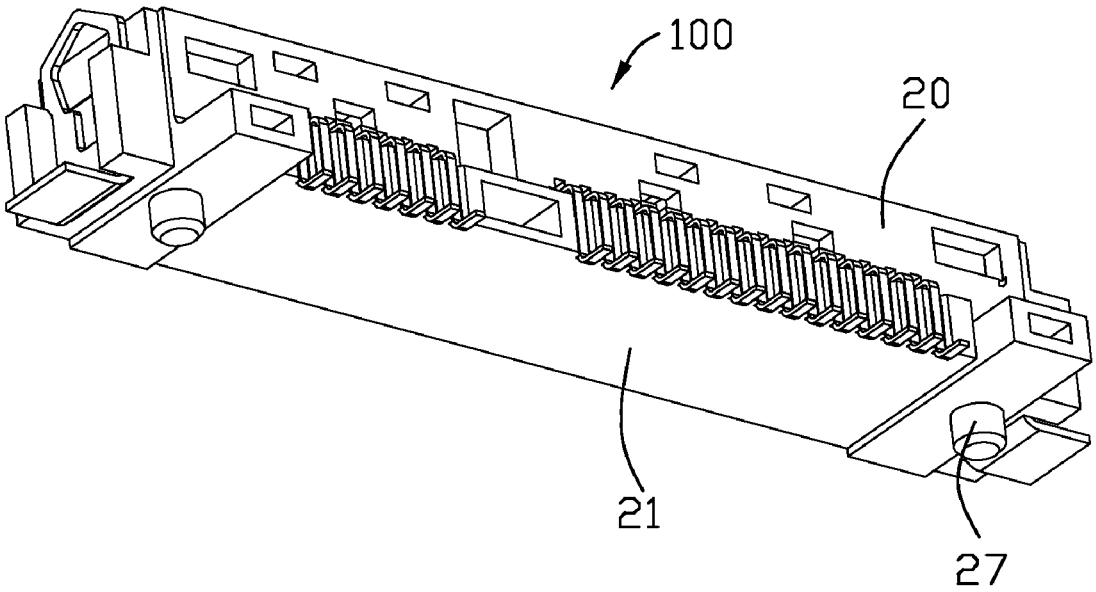
FIG. 5 is a perspective view of the electrical connector.
Figure 6:
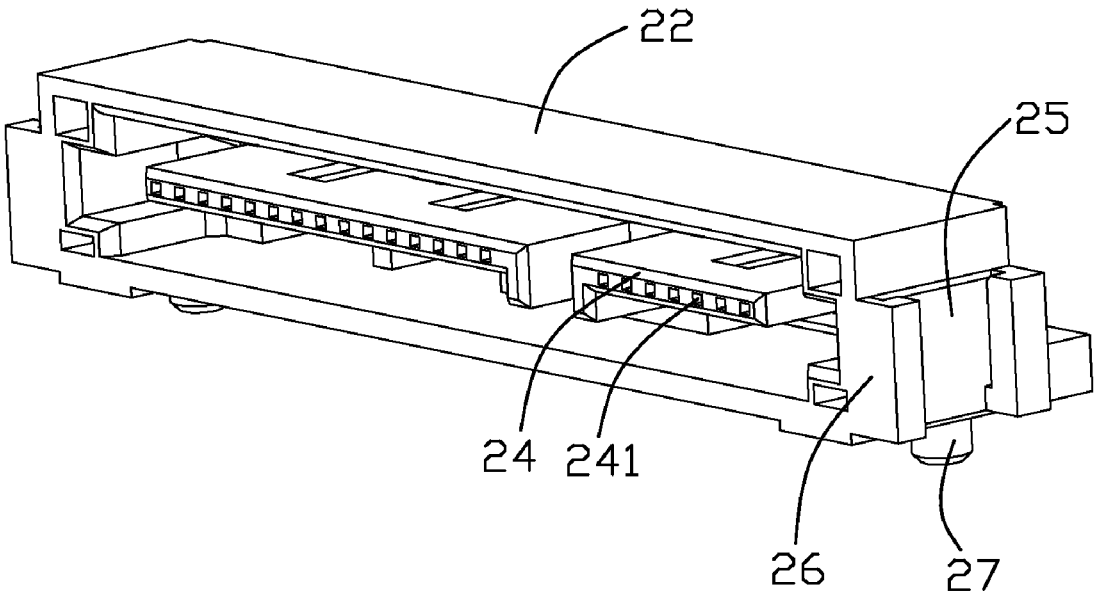
FIG. 6 is a perspective view of the insulative housing of the electrical connector of FIG. 5.

Referring particularly to FIG. 4 to 6, the insulative housing 2 defines an elongated main body 28 with two opposite retaining sections 29 at two longitudinal ends thereof and a pair of mating tongues 24. A pair of boardlock-receiving cavities 25 are configured in opposite retaining sections 29 of the main body 28 thereof, respectively. The main body 28 and the mating tongues 24 define a front mating face 26, a receiving space 23, a horizontal mounting surface 21 and a top surface 22 opposite to the mounting surface 21. The mating tongues 24 extend forwardly and received in the receiving space 23 of the main body 28. Each mating tongue 24 defines a plurality of locking holes 241 formed in the mating interface 26.

Figure 7:
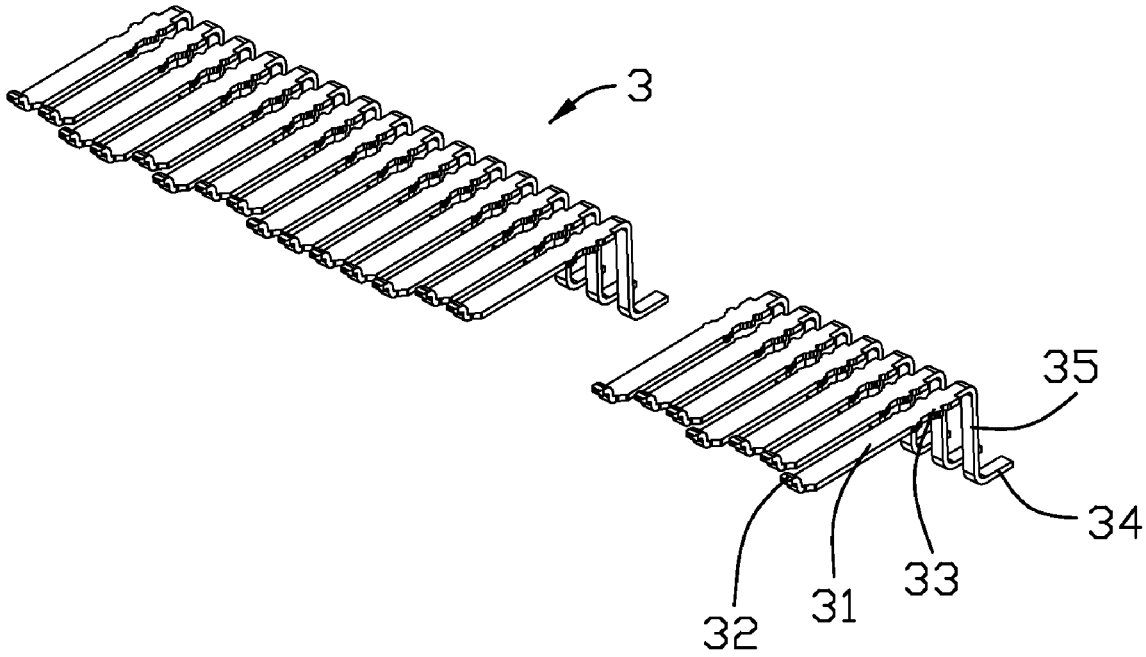
FIG. 7 is a perspective view of terminal assembly of the electrical connector of FIG. 5.

Combination with FIG. 7, each conductive terminal 3 defines a retention section 33 retained in the main body 28 of the insulative housing 2, a contact section 31 extending from the front end of the retention section 33 located within corresponding passageway of the mating tongues 24, a transition section 35 perpendicularly extending from the back end of the retention section 33 toward the mounting surface 21, and a soldering section 34 perpendicularly extending from the transition section 35 and exposing in the mounting face 21 of the main body 28 for electrically connecting a corresponding pad 51 disposed in the PCB 5. In addition, a locking section 32 is shaped at a front free end of the contact section 31 and respectively received in the locking holes 241 of the mating tongues 24 for preventing the contact section 31 of terminal 3 from warping.

Figure 8:
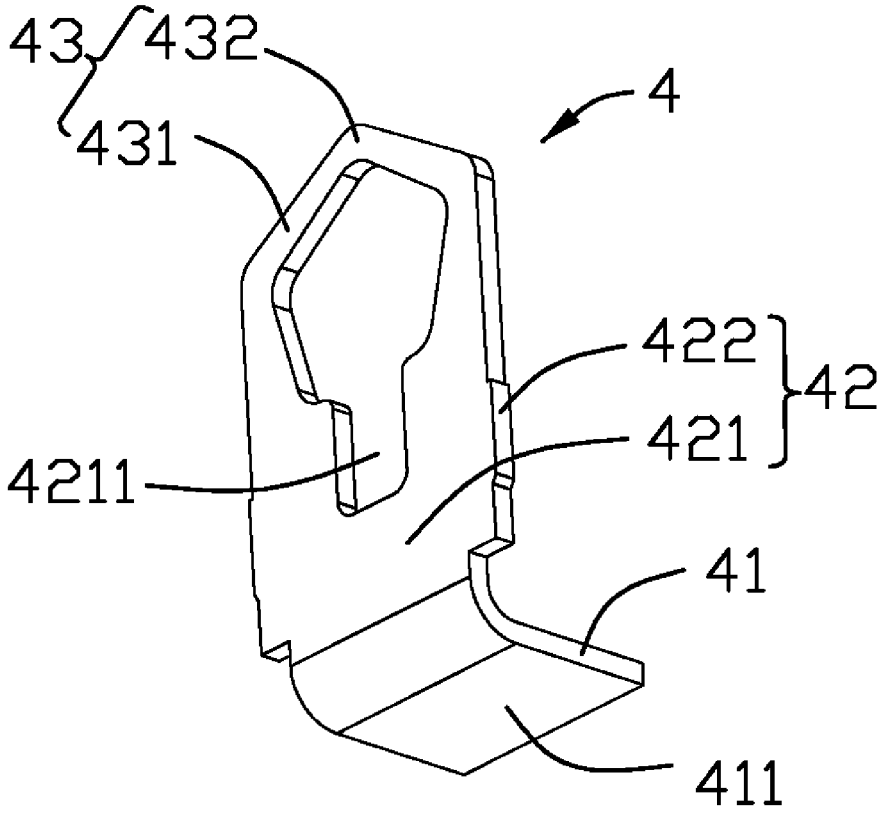
FIG. 8 is a perspective view of a board lock of the electrical connector of FIG. 5.
Figure 9:
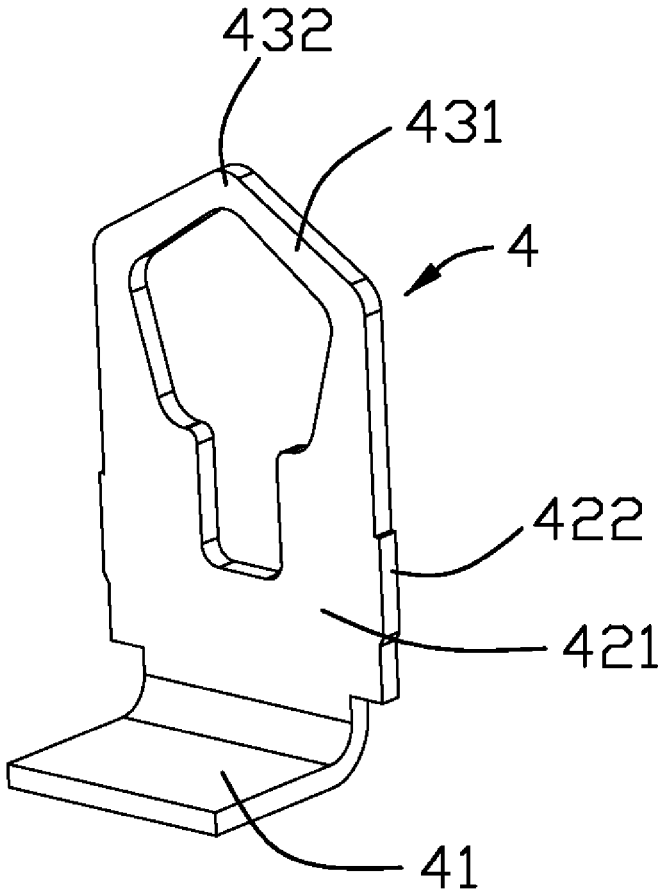
FIG. 9 is another perspective view of the board lock of FIG. 8.

Combination with FIGS. 8 and 9, each board lock 4 comprises a body portion 42 secured in respective boardlock-receiving cavity 25 of the housing 2, a connection portion 41 perpendicularly extending from the lower end of the body portion 42 for being connected to the printed circuit board 5, and an elastic portion 43 extending upwardly from the upper end of the body portion 42 and beyond the top surface 22 of the body 28. The body portion 42 defines a cutout 4211 in the upper end and barbs 422 on both sides. The elastic portion 43 comprises two spring arms 431 that diverge from opposite sides of the body portion 42 and then converge to the contact point 432 protruding above the top surface 22 and abutting against the optical disk drive 600. The connection portion 41 is perpendicular to the body portion 42 and defines an engaging surface 411 which is coplanar with the mounting surface 21. The retention between the elastic portion 43 of the board locks 40 and the optical disk drive 600 significantly enhances the retention between the electrical connector 100 and the optical disk drive 600.

In assembly, the terminals 3 are inserted into the insulative housing 2 from a back surface 20 opposite to the front mating face 26, the pair of board locks 40 are inserted into boardlock-receiving cavities 25 of the insulative housing 2 in a lower to top direction, respectively. Secondly, the electrical connector 100 is mounted onto the printed circuit board 1. A pair of posts 27 of the housing 2 are inserted into corresponding holes, the connection portions 41 of the board locks 4 are soldered to the printed circuit board 1, the soldering sections 34 of the terminals 3 are soldered to the corresponding pad 51 of the printed circuit board 1, respectively. Thirdly, the printed circuit board 1 with the electrical connector 100 is mounted into a cover 700, then the cover 700 with the electrical connector assembly is assembled to the optical disk drive 600.

While a preferred embodiment in accordance with the present invention has been shown and described, equivalent modifications and changes known to persons skilled in the art according to the spirit of the present invention are considered within the scope of the present invention as described in the appended claims.

What is claimed is:

1. An electrical connector comprising:

an insulative housing comprising an elongated main body having a horizontal mounting surface and a top surface opposite to the mounting surface, the main body defining a pair of boardlock-receiving cavities;

a plurality of conductive terminals secured in the housing; and a pair of board locks each comprising a body portion received in the boardlock-receiving cavity, a connection portion connected with a printed circuit board on which the electrical connector intend to be mounted, and an elastic portion extending upwardly beyond the top surface of the main body;

wherein the elastic portions respectively extend along a top-to-bottom direction perpendicular to the top surface to provide elasticity deformation along said top-to-bottom direction.

2. The electrical connector as described in claim 1, wherein the connection portions are perpendicular to the body portions and each defines an engaging surface coplanar with the mounting surface.

3. The electrical connector as described in claim 2, wherein the elastic portion defines a contact point protruding above the top surface and abutting against an optical disk drive.

4. The electrical connector as described in claim 3, wherein the elastic portion comprises two spring arms diverging from the body portion and then converging to the contact point.

5. An electrical connector comprising:

an insulative housing defining a receiving space surrounded by opposite first and second sidewall and opening forwards;

a plurality of conductive terminals loaded in the insulative housing and exposing to the receiving space; and a pair of board locks retained in the insulative housing, each board lock configured as L-shape and comprising a first planar portion parallel to the second sidewall and a second planar portion perpendicularly bending from the first planar portion, each second planar portion having barbs at lateral edges thereof and adjacent to the first planar portion to be retained in the insulative housing;

wherein the second planar portion defines a triangular free end thereof extending beyond the first sidewall, and the second planar portion defines an open therein so as to make the second planar portion have elasticity.

6. The electrical connector as described in claim 5, wherein two mating tongues are located in the receiving space and the terminals are loaded on the mating tongues.

7. An electrical connector assembly comprising:

an optical disk drive cooperating with a cover to commonly define a receiving space;

an electrical connector mounted upon a printed circuit board to commonly received in said receiving space under condition that the printed circuit board is seated upon the cover; and said connector including an elongated insulative housing with a pair of board locks located at two opposite ends and soldered to the printed circuit board, respectively; wherein each of said board locks defines a deflectable upper end section extending vertically beyond a top surface of the insulative housing and upwardly abutting against the optical disk drive.

8. The electrical connector assembly as claimed in claim 7, wherein the housing defines a pair of upward receiving cavities, so as to allow the corresponding board lock to be downwardly assembled thereinto.

* * * * *